US005335466A

United States Patent [19]

Langohr

[11] Patent Number: 5,335,466

[45] Date of Patent: Aug. 9, 1994

[54] WIDE VERTICAL JOINT SEAL

[76] Inventor: Donald R. Langohr, 11538 Norway, Hartland, Mich. 48235

[21] Appl. No.: 984,861

[22] Filed: Dec. 1, 1992

[51] Int. Cl.[5] ..... F04B 1/62; E04F 15/14

[52] U.S. Cl. ..... 52/396.04

[58] Field of Search ..... 52/366, 396, 402, 403, 52/407, 417, 444, 453, 573

[56] References Cited

U.S. PATENT DOCUMENTS

| | | | |
|---|---|---|---|
| 2,228,052 | 1/1941 | Gardner . | |
| 2,290,424 | 7/1942 | Grund | 72/107 |
| 3,099,110 | 7/1963 | Spaight . | |
| 3,334,557 | 8/1967 | Fitzgibbon . | |
| 3,520,096 | 7/1970 | Kilcher | 52/396 |
| 3,629,986 | 12/1969 | Klittich | 52/396 |
| 4,058,947 | 11/1977 | Earle et alia | 52/396 |
| 4,601,604 | 7/1986 | Clark et al. | 52/396 X |
| 4,622,794 | 11/1986 | Geortner | 52/403 |
| 4,761,927 | 8/1988 | O'Keeffe et al. | 52/403 |
| 4,784,516 | 11/1988 | Cox | 52/396 |
| 4,922,676 | 5/1990 | Spronken | 52/396 |
| 5,168,683 | 12/1992 | Sanson et al. | 52/403 X |

*Primary Examiner*—Neill R. Wilson

*Attorney, Agent, or Firm*—Weintraub, DuRoss & Brady

[57] ABSTRACT

A vertical expansion joint for connecting substrates in new of existing structures provides a fabricated seal, comprising a strip of cured, low modulus silicone attached to an open-cell polyurethane backer foam or, alternately, a closed cell polyethylene foam. The silicone strip of the joint is narrower than the backer foam and compatible with construction grade sealants, neutral cure sealants and room-temperature vulcanized sealant. The seal is inserted into the joint to be filled. A wet silicone sealant into the recessed areas on either side of the cured silicone strip. The wet sealant dries and creates a bond between the strip and the substrates. The resulting bond allows extreme expansion and contraction of the curtainwalls or substrates, while maintaining a watertight seal.

8 Claims, 2 Drawing Sheets

FIG 1
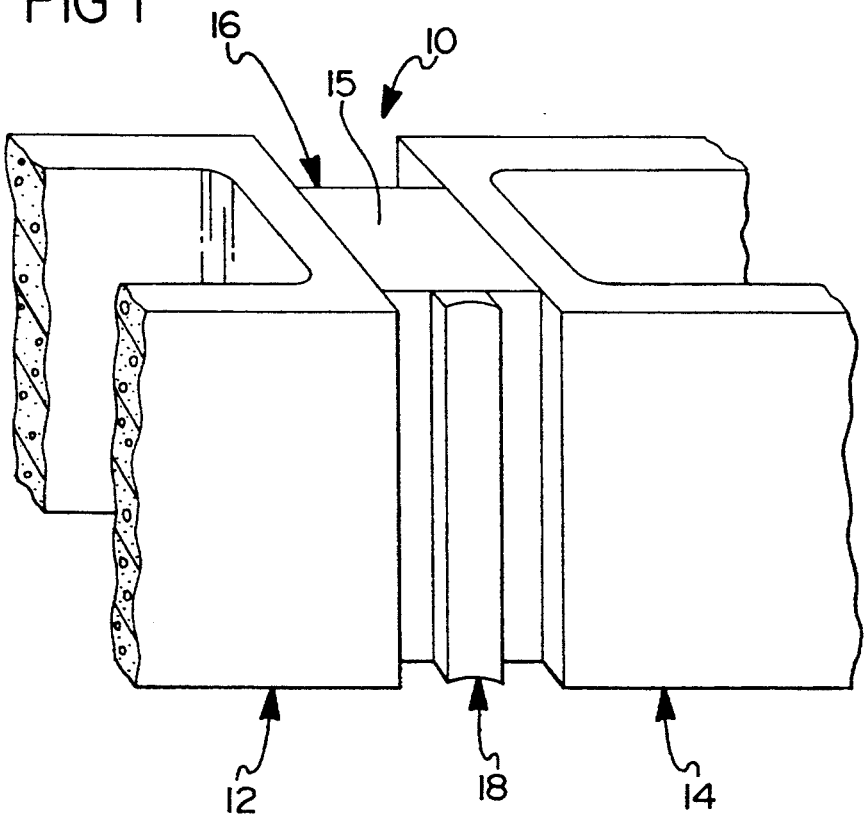
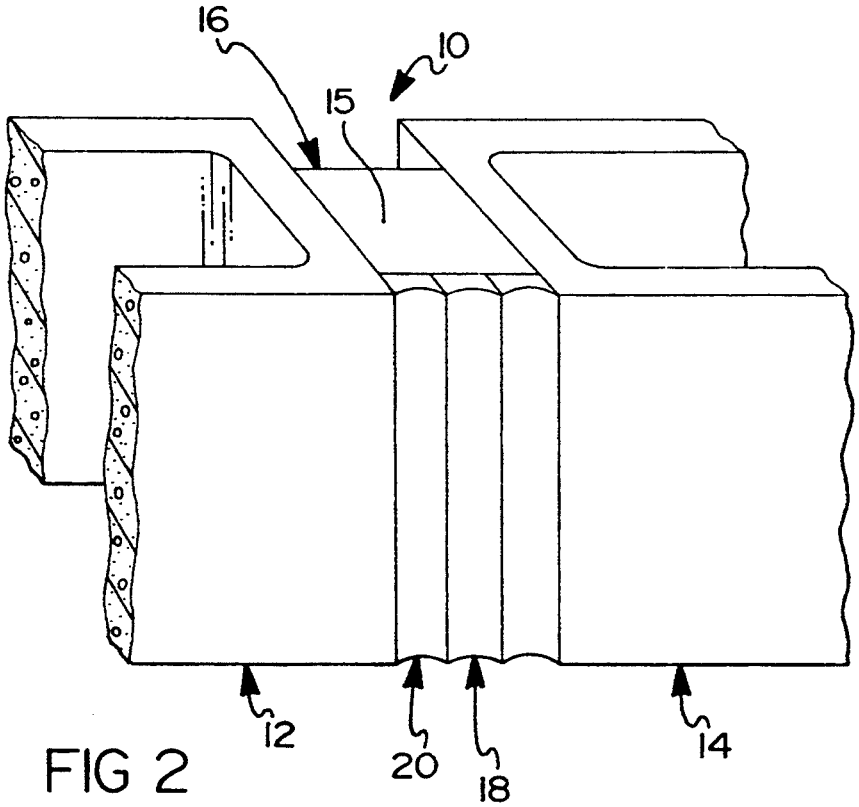
FIG 2

FIG 3
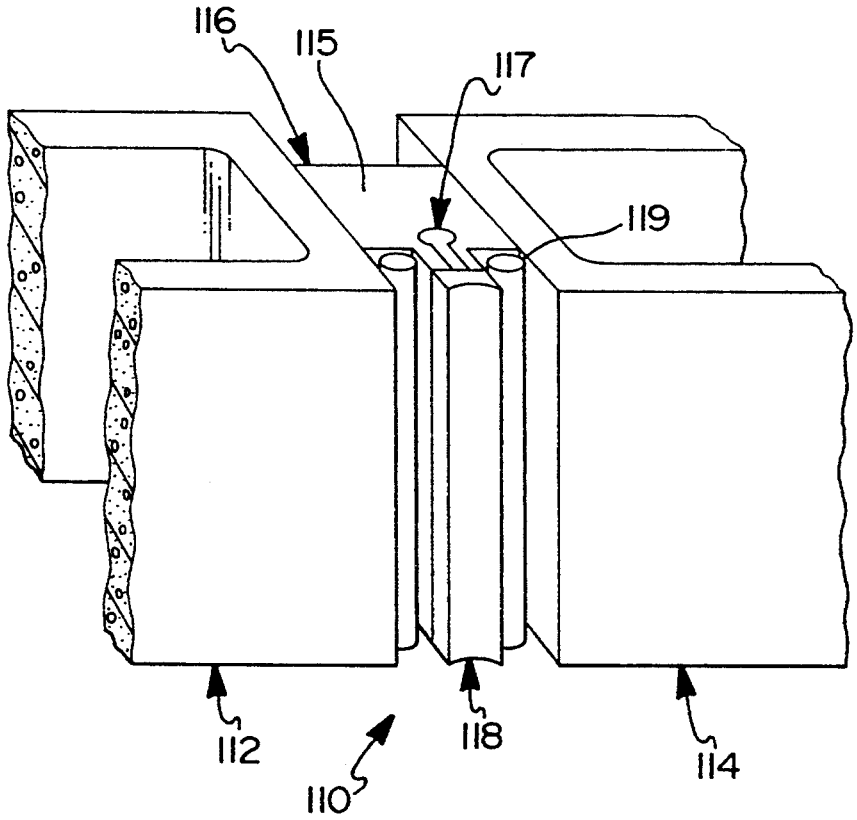
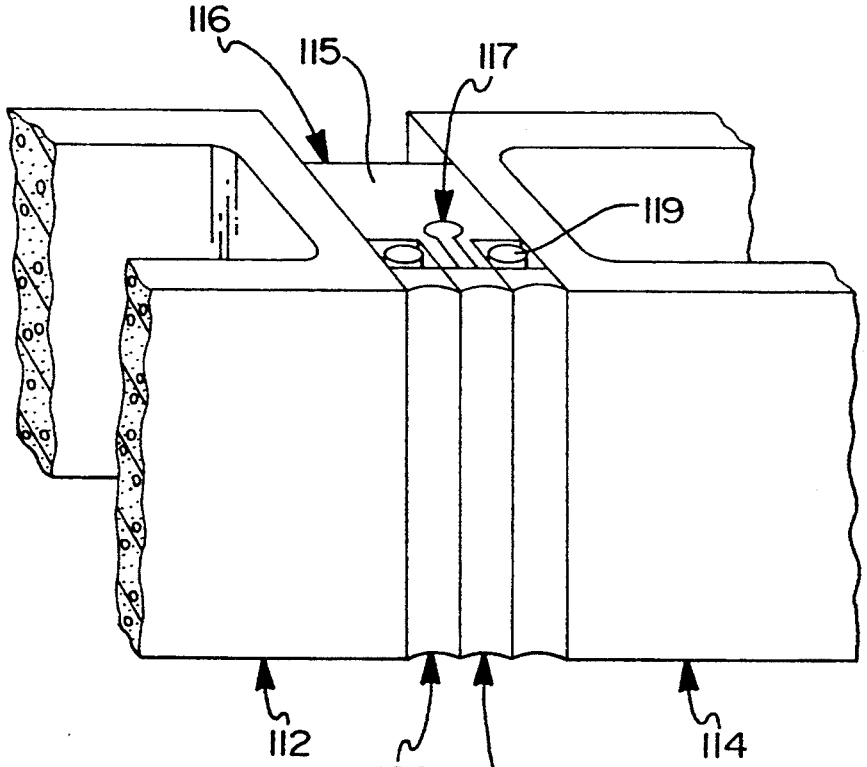
FIG 4

WIDE VERTICAL JOINT SEAL

BACKGROUND OF THE INVENTION

1. Field of the Invention

The present invention concerns joints utilized in structures. Even more particularly, the present invention concerns larger vertical joints in curtain wall applications allowing expansion and contraction of the wall substrate while maintaining a water-tight seal.

2. Description of the Prior Art

In the construction of buildings and roads having multiple panels therein, there has long existed the need for joints and other similar means to connect substrates and accommodate the expansion of these substrates due to thermal conditions. Such joints used in highways have been termed horizontal joints. Those utilized in buildings, notably in skyscrapers, have been termed vertical joints. Those joints within buildings which interconnect with vertical joints or other vertical members are termed vertical-horizontal joints.

In selecting among the known materials to form a vertical joint, architects have heretofore abstained from using silicone sealants. This has been due to the size of the joints, usually over ¾ inch in width and often 1 and ¼ inches or more. Silicone is normally applied wet in this type of joint. Before solidifying, the silicone would readily sag and slump within the joint. This produced an uneven joint, which could not perform in the needed manner nor insure a watertight seal.

Architects therefore turned to other materials, most notably rubber and neoprine. These natural products perform the necessary task a joint must. However, joints made from these materials suffer from drawbacks. Firstly, the cost of these materials is high. Additionally, the labor necessary to construct these joints is great, and these joints often require plates or other similar support structures therein. Further, the joints effected with these materials are often aesthetically unpleasing. Finally and most importantly, these materials deteriorate with exposure to the elements, particularly to ultraviolet light which is contained with sunlight. That these materials have a somewhat limited lifespan is marked by the industry warranties of these materials in such joints for a maximum of five years.

Silicone offers a jointing material that is relatively unaffected by ultraviolet light and exposure to the elements. It is also a very resilient material, thus quite suited for work in a joint. Industry warranties of twenty years attest to the durability and desirability of silicon in joints. Therefore, there exists a need in the construction arts for a device to effect a vertical joint comprising silicone, as well as a need for a vertical silicone joint, particularly in but not limited to large-scale construction.

An example of a common method known to those skilled in the art to effect joints is set forth in U.S. Pat. No. 3,334,557 issued Aug. 8, 1967 to Fitzgibbon and is entitled "POLYURETHANE CONCRETE SLAB SEALER". Fitzgibbon teaches the filling of a gap between concrete slabs in a roadway with plastic polyurethane liquid materials to provide a horizontal joint. The liquid material expands after placement and expands to a volume that fills the gap. The deployment of the liquid sealant, in situ, affords full coverage of space while affording a waterproof material.

However, problems result if such a system is attempted in a vertical setting. Firstly, there are problems in pouring or applying the liquid sealant. Devices or mold structures to prevent the run-off of the sealant due to gravity, such as boards over the gap or opening, would have to be developed. Time must be spent assembling and later disassembling these mold structures. These devices would not, however, address the problems of even distribution of the silicone sealant. Further, time is lost while allowing the sealant to dry. Finally, finishing processes must be applied to complete the joint.

A vertical joint is found in U.S. Pat. No. 4,058,947 issued to Nov. 22, 1977 to Earle et alia and is entitled "FIRE RESISTANT JOINT SYSTEM FOR CONCRETE STRUCTURES". Earle teaches a joint comprising a refractory fiber mass which is wedged in the gap between adjacent concrete panels. Frictional forces hold the fiber mass within the gap. A backup component is deployed atop the fiber mass. Atop this backup component is deployed the sealant. The sealant is disposed and dried in contact with the backup component and the concrete panels.

The Earle patent does not provide connection between the fiber mass and the sealant. Thus, the mass can be dislodged as the panels contract and expand. Further, this lack of connection does not give any backing to the sealant, which could be torn or otherwise broken by the movement of the building. Thus, the joint of Earle can fail during use.

It is unknown in the art, to the best of the Applicant's knowledge, to effect a vertical joint utilizing silicone, and particularly of joints of the size commonly found in large-scale construction. It is to these needs that the present invention is directed.

SUMMARY OF THE INVENTION

The present invention is a filler for effecting a joint in a vertical gap between adjacent substrates of a structure. The filler of the present invention comprises:

(a) a backer comprising a planar member for insertion into the gap and for retention of the seal within the gap; and (b) a cured sealant disposed upon the backer.

The filler may further comprise a keyway deployed within the backer and extending thereabove, the keyway being covered with the sealant to be cured thereon and lend structure thereto.

The present invention may also comprise a joint to connect substrates in a structure, the joint comprising the filler described above and further comprising a wet sealant disposed thereabout. The joint may further comprise at least one backing rod therein.

For a more complete understanding of the present invention, reference is made to the following detailed description and accompanying drawings. In the drawings, like reference characters refer to like parts throughout the several views, in which:

BRIEF DESCRIPTION OF THE DRAWINGS

FIG. 1 is a perspective view of a first embodiment of the present invention deployed between two substrates;

FIG. 2 is the first embodiment of the present invention as shown in FIG. 1 further having a wet sealant deposited in the interstices therein;

FIG. 3 is a perspective view of a second embodiment of the present invention deployed between two substrates; and FIG. 4 is a perspective view of the second embodiment as shown in FIG. 3 and further having a wet sealant deposited in the interstices thereof.

DETAILED DESCRIPTION OF THE PREFERRED EMBODIMENTS

With reference now to FIGS. 1 and 2, there is shown therein a first embodiment of the present invention, to wit, a vertical joint 10. The joint 10 is deployed between two adjacent or abutting substrates or slabs 12, 14. The substrates 12, 14 may comprise any of the commonly known building materials, such as concrete, brick, wood, steel or other metals, and glass. The substrates 12, 14 define the gap in which a vertical joint 10 will be effected. As seen in FIG. 1, a filler 15 is disposed between the substrates 12, 14 of the structure. The filler 15 comprises a backer or backing 16 and a cured sealant 18.

The backer 16 comprises a resilient yet sturdy material. The backer 16 is a planar member. In the preferred embodiment, the backer 16 comprises a flexible, open cell polyurethane foam. Other suitable materials, such as a closed cell, flexible polyethylene foam may be used. Such materials are well-known and readily commercially available.

The critical factors in selecting the backer material is to select a material that can be compressed to fit within a gap and that will form a connection with the sealant disposed thereon. It is vital, however, that the bond made between the backer 16 and the sealant 18 not be permanent or strong. Rather, the bond need be solid only for the temporary period in which the joint 10 is finished by the application of the wet or bead sealant, as will be discussed herein below. The backer 16 is formed to a size that is larger that the space the joint 10 is to be deployed into, as will also be explained further herein below.

The sealant 18 is caulked atop the backer 16 and hardened thereon. The sealant 18 is, in the best mode of practicing the present invention, formed of cured silicone, for the reasons set forth for preferring silicone as a joint material herein above. A less preferred alternative would be polyurethane. The sealant 18 is caulked deposited upon the backer 16 wet and allowed to dry. The amount of sealant 18 disposed on the backer 16 is determined by the size of the gap to be filled between the substrates 12, 14 and the thickness of the sealant 18 necessary in the joint 10. Thus, each joint 10 is performed to a desired size, as needed in each application. Additionally, the preformed filler 15 may be mass-produced in standard sizes to effect joints of common or expected sizes.

As shown in FIG. 2, the installation of the joint 10 can be finished by the application of a wet or bead sealant 20 once the filler 15 has been deployed with the gap between the two substrates 12, 14. Bead sealants 20 are quick-drying sealants which can supply the necessary bond between the substrates 12, 14 and the cured sealant 18. Thus, the joint 10 will have an adhesive contact between the cured sealant 18 of the filler 15 and the substrates 12, 14. One suitable bead sealant known to those skilled in the art is Rhodorsil 5C, sold by Rhone-Poulenc.

The joint 10 is deployed in the following manner. The backer 16 is compressed to fit within the gap. The cured sealant 18 is positioned such that upper surface of the sealant 18 is substantially coplanar with the surfaces of the substrates 12, 14. To effect contact between the dried, cured sealant 18 and the substrates 12, 14, the bead sealant 20 is then applied. Thus, a flexible and waterproof joint is deployed in a vertical situation quickly and efficiently.

There are multiple advantages to the joint 10. Firstly, the joint 10 eliminate the in situ pouring or other deployment of the liquid sealant, which can be inexact, messy and inefficient. Additionally, the joint 10 can be sized to fill commonly spaced gaps and brought to each building site. Thus, job time can be saved by the quick installation of these joint 10. By the application of bead sealant, gaps of similar to somewhat greater width than the width of the sealant 18. The bead sealant 20 may be used to fill gaps of varying size. Additionally, this joint 10 will accommodate the minor structural fluctuations found in construction, such as imperfectly straight wall or substrates. Such expected irregularities can be accommodated by the joint 10 by the lessening of or the adding of bead sealant 20.

Finally, a cured silicone sealant 18 disposed within the gap upon the filler 15 prior to the application of the bead sealant 20 in a wide gap, such as those of 1 and ¼ inches or greater, eliminates the slumping and sagging most commonly identified with wet sealants in said applications. This uniformity of distribution achieves the desired joint of a superior material in a setting heretofore unachievable.

It is noted that the present invention is highly applicable to large gaps and forming joints of 1 inch or greater. The present invention can also be utilized in smaller gaps by reducing the size of the backer and associated cured sealant thereon.

Referring now to FIGS. 3 and 4, there is shown a second embodiment of the present invention. The joint 110, as in the first embodiment, has a filler 115 comprising a backer 116 and a sealant 118. A keyway 117 is deployed in the backer 116. The keyway 117 is formed of silicone ideally and preferably, although other suitable material can be used. It is critical that the material forming the keyway 117 bond well with the cured sealant 116.

The keyway 117 comprises a slender planar member, such as a strip of a small thickness. The keyway 117 is embedded within the backer 116 by forming a slit with the backer 116 and adhering the keyway 117 therein, or by forming the backing 116 around the keyway 117. However the keyway is implanted in the backer 116, the keyway 117 extends above the surface of the backer 116. The keyway 117 serves to effect greater contact between the backer 116 and the sealant 118. Thus, selection of the material comprising the keyway 117 must be made toward increasing the securement between the backer 116 and the sealant 118.

The joint 110 may further comprises a plurality of backer rods 119. The rods 119 are positioned along each side of the keyway 117 and the cured sealant 118. The rods 119 are formed of polyethylene and are readily commercially available. The rods 119 are solid cylindrical members formed into the sealant 118 and rest atop the backer 116. The rods 119 serve to fill space of the joint 110 and give a surface of support when the bead sealant 120 is applied. This eliminates the need of pouring high amounts of sealant therein and spending valuable time effecting drying the sealant. Further, it avoids the slumping and other associated problems incurred when applying large amounts of silicone sealants in a vertical joints, as detailed above. The application of the bead sealant 120 effects a waterproof joining of the substrates 112, 114, the cured sealant 118 and the rods 119.

Having, thus, described the invention, what is claimed is:

1. A seal for effecting a joint in a gap between adjacent substrates of a structure, the seal comprising:

(a) a backer comprising a planar member for insertion into the gap and for retention in the gap and for retention of the seal within the gap, (b) a keyway disposed partly within the backer and extending substantially the length of the backer, and (c) a cured sealant, the cured sealant being disposed upon the keyway and the backer.

2. The seal of claim 1, wherein the backer comprises a polyurethane foam.

3. The seal of claim 1, wherein the backer comprises a polyethylene foam.

4. The seal of claim 1, wherein the sealant is silicone.

5. The seal of claim 1, further comprising: at least one backing rod deployed between the cured sealant and the backer.

6. An expandable joint for connecting substrates in a structure, the joint comprising:

(a) a seal disposed between two adjacent substrates of the structure, the seal comprising:

(1) a backer; and (2) a cured sealant disposed on the backer, the backer, the cured sealant and each substrate cooperating to form an interstice; and (b) a wet sealant deployed within the interstices; wherein the wet sealant dries and forms a bond between the substrates and the cured sealant of the seal, effecting a waterproof, weather-resistant expandable joint.

7. The joint of claim 6, further comprising: at least one backing rod formed with the cured sealant and the backer, the wet sealant being disposed above the at least one backing rod.

8. The joint of claim 6, wherein the seal further comprises:

a keyway disposed within the backer and extending thereabove, the sealant being deployed atop the keyway and backer.

* * * * *